US006415468B1

(12) United States Patent
Spaur

(10) Patent No.: US 6,415,468 B1
(45) Date of Patent: Jul. 9, 2002

(54) CONCRETE FORM SNAP TIE TOOL

(76) Inventor: William F. Spaur, 1666 Rice Ave., Titusville, FL (US) 32796

( * ) Notice: Subject to any disclaimer, the term of this patent is extended or adjusted under 35 U.S.C. 154(b) by 0 days.

(21) Appl. No.: 09/816,258

(22) Filed: Mar. 26, 2001

(51) Int. Cl.[7] ..... B25D 1/04

(52) U.S. Cl. ..... 7/143; 81/44; 254/25; 254/131

(58) Field of Search ..... 7/143, 170; 81/44; 254/25, 28, 29 R, 29 A, 131; 29/270, 278

(56) References Cited

U.S. PATENT DOCUMENTS

| | | | | | |
|---|---|---|---|---|---|
| 705,555 | A | | 7/1902 | Boatright | |
| 1,581,119 | A | * | 4/1926 | Herring | 7/170 |
| 2,525,226 | A | * | 10/1950 | Lawellin | 254/25 |
| 2,556,343 | A | | 6/1951 | Shearer | |
| 3,680,835 | A | | 8/1972 | Rose | |
| 3,713,200 | A | * | 1/1973 | Burns | 254/131 |
| 3,756,562 | A | | 9/1973 | Ward | |
| 3,965,720 | A | * | 6/1976 | Goodwin et al. | 254/131 |
| 4,422,489 | A | * | 12/1983 | Ross | 81/44 |
| 5,535,982 | A | | 7/1996 | Zayic | |
| 5,577,711 | A | * | 11/1996 | Shine | 254/25 |
| 6,205,602 | B1 | * | 3/2001 | Dettweiler | 7/173 |

* cited by examiner

*Primary Examiner*—Eileen P. Morgan
*Assistant Examiner*—Joni B. Danganan
(74) *Attorney, Agent, or Firm*—William M. Hobby, III

(57) ABSTRACT

A concrete form snap tie tool apparatus has an elongated body having two end portions, one end portion has a handle thereon and the other end portion has two sides, each side having an angled slot therein for engaging a snap tie in the assembly of a concrete form. One side slot is angled for pulling a snap tie while the other side slot is angled for pushing a snap tie for aligning a snap tie with an aperture in a concrete form wall. The concrete form snap tie tool allows the rapid assembly of a concrete form by the quick engagement of a snap tie with the tool and the alignment of a snap tie with an opening in the concrete form wall. An elongated body also has a passageway having a sleeve slidably mounted therein and having a hitting surface on one end thereof. The elongated body is formed with a nail support at one end thereof for supporting a nail. A hammer or the like is used to drive the sleeve against the nail to drive the nail into a surface.

4 Claims, 2 Drawing Sheets

CONCRETE FORM SNAP TIE TOOL

BACKGROUND OF THE INVENTION

The invention relates to a tool for use in the erection of concrete forms and especially to a concrete form snap tie tool for aligning a snap tie during the assembly of the concrete form.

Concrete shapes, such as walls and the like, are often poured on the job site with the aid of forms having plywood walls. Each wall has an inner facing sheet of plywood and the like secured to an outer frame including spaced timbers, such as 2×4's, commonly referred to as "whalers". The form is constructed by placing the form walls side-by-side, passing tie rods between the walls, and exerting a pulling force on each tie rod to draw the wall towards one another onto spacing collars or shoulders of the tie rod. The rod ends extend between the outer form wall and are secured to the walls by means of wedges referred to as "wedge clamps" which are wedged tightly between heads on the tie rod ends and the whalers. These hair pins retain inner wall facing sheets and firm lifting contact with the tie rod spacing shoulders which in turn provide the proper spacing between the facing sheets.

The present invention relates to a concrete form snap tie tool which is used to align the end of a snap tie for insertion through one of the walls of the concrete form. Only the person assembling the concrete form must reach inbetween the two walls and remotely grasp the snap tie for aligning it with a small hole predrilled into the preformed wall. The present invention allows a tool to be utilized for insertion between form walls for engagement with a snap tie for pulling or pushing the snap tie into position for alignment with an aperture in the form wall. The present concrete form snap tool also includes a nail holding driving tool portion which allows the rapid assembly of form components.

SUMMARY OF THE INVENTION

A concrete form snap tie tool apparatus has an elongated body having two end portions, one end portion has a handle thereon and the other end portion has two sides, each side having an angled slot therein for engaging a snap tie in the assembly of a concrete form. One side slot is angled for pulling a snap tie while the other side slot is angled for pushing a snap tie for aligning a snap tie with an aperture in a concrete form wall. The concrete form snap tie tool allows the rapid assembly of a concrete form by the quick engagement of a snap tie with the tool and the alignment of a snap tie with an opening in the concrete form wall. An elongated body also has a passageway having a sleeve slidably mounted therein and having a hitting surface on one end thereof. The elongated body is formed with a nail support at one end thereof for supporting a nail. A hammer or the like is used to drive the sleeve against the nail to drive the nail into a surface. The tool can also be used for breaking off snap ties when stripping or disassembling concrete forms after the concrete pour.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
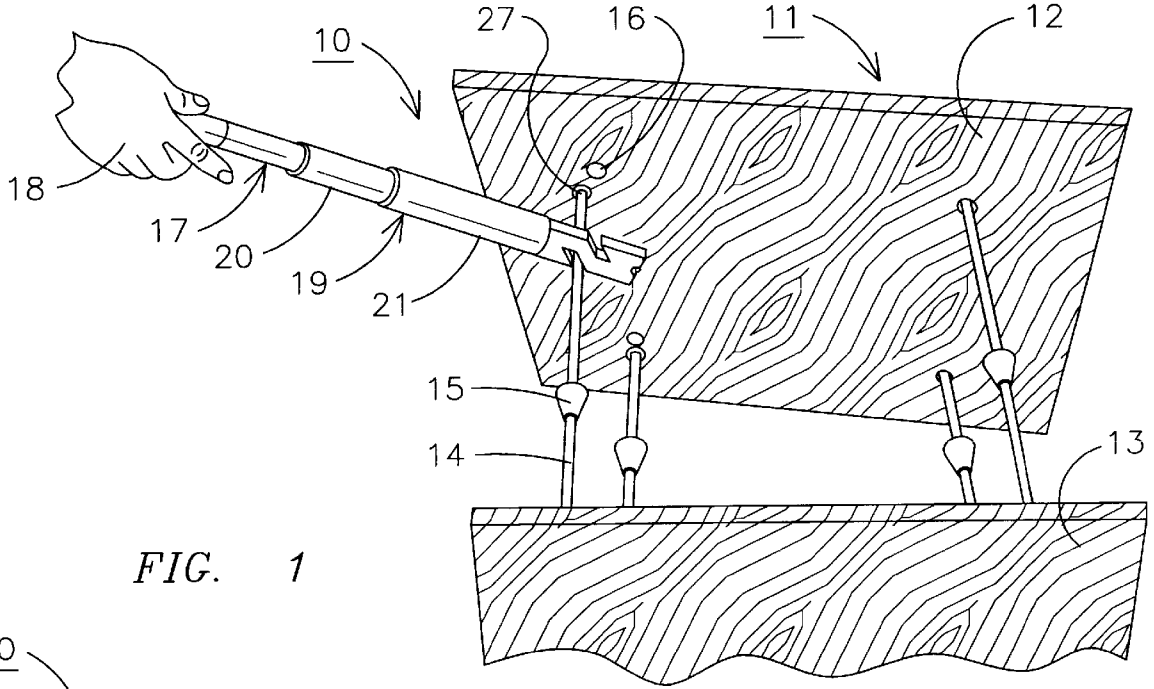
FIG. 1 is a perspective view of a concrete form snap tie tool in accordance with the present invention being used in the assembly of a concrete form.
Figure 2:
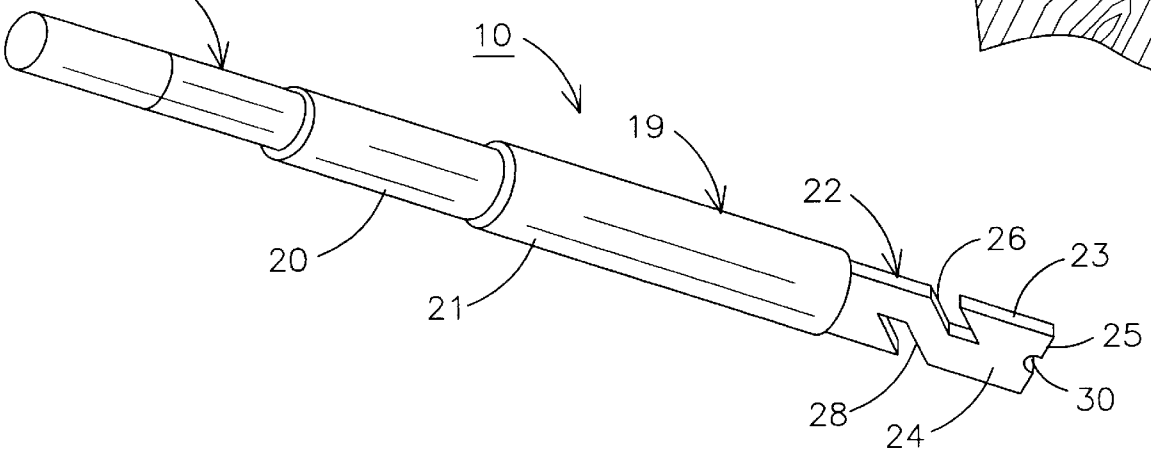
FIG. 2 is a perspective view of a concrete form snap tie tool of FIG. 1.
Figure 3:
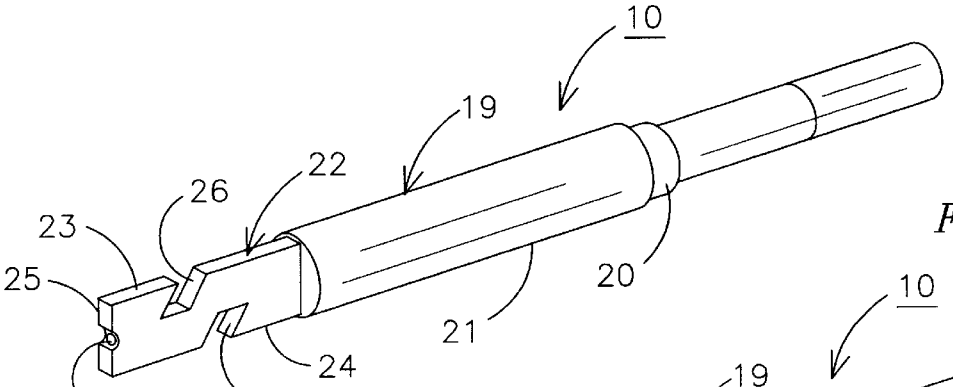
FIG. 3 is a perspective view of a concrete form snap tie tool telescoped inward.
Figure 4:
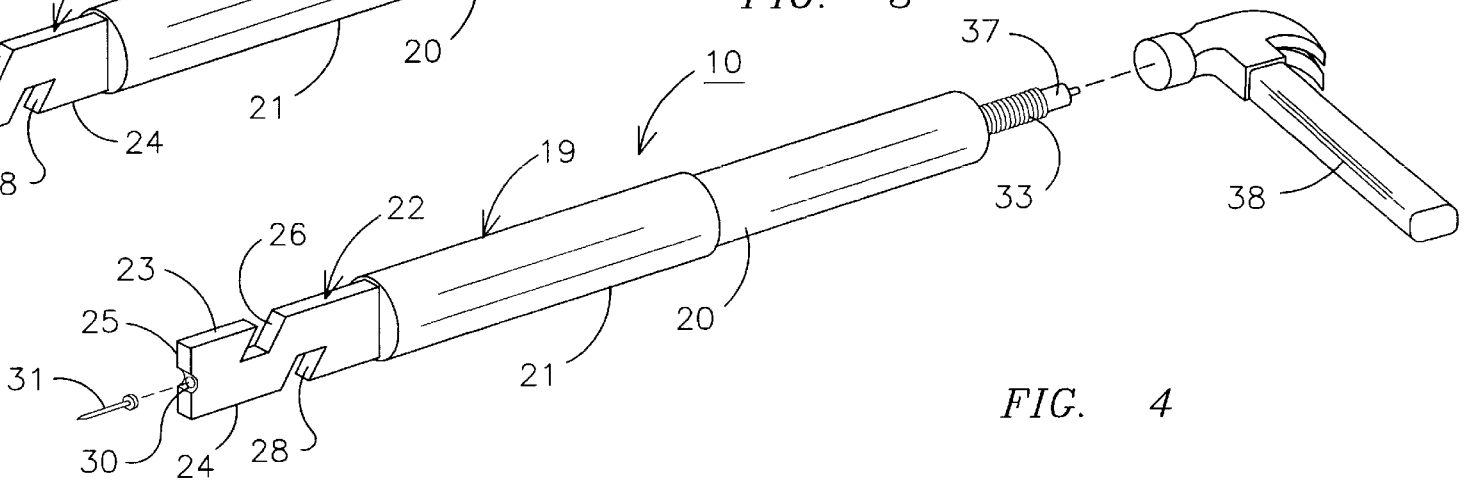
FIG. 4 is a perspective view of the concrete form snap tie tool of FIG. 3 illustrating the driving of a nail herewith.

Referring to FIGS. 1–5, a form snap tie tool 10 of FIG. 1 is used to assemble a concrete form 11 having a first wall 12 and a second wall 13. Walls 12 and 13 are being mounted parallel to each other to form a concrete form and are being poured and spaced apart with a plurality of tie rods 14. The tie rods have spacing collars 15 thereon for spacing the walls 12 and 13 a predetermined distance and parallel to each other. The walls 12 and 13 are typically made of plywood and have predrilled holes 16 therethrough aligned for inserting the tie rods 14 through the holes until the shoulders of the collar 15 abut against the inside of the walls 12 and 13. Typically each tie rod 14 will have a pair of collars 15, one for pushing against each wall 12 and 13, forming the concrete form 11 for pouring concrete therein. Walls 12 and 13 must be locked together with the snap ties which requires that the snap ties be inserted through the openings 16 opposite walls and pulled through to pull each wall against the collar 15 setting the wall a predetermined spacing from each other. The present snap tie tool 10 is directed towards a tool to assist in grasping the snap ties 14 and aligning each snap tie with an opening 16 in a wall 12 or 13. The snap tie tool 10 has a handle end 17, shown in FIG. 1 being grasped by a person's hand 18, telescoping portions 20 and 21, and a working end 22. The working end 22 has two side edges 23 and 24 and front end edge.

Side 23 has an angled slot 26 therein angled in a direction so that it can be slid to engage a snap tie 14 to be pulled by the tool 10 for directing an end 27 of the snap tie 14 into the aperture 16. An angled slot 28 located on the opposite side 24 of the working end 22 of the snap tie tool 10 is angled in a direction parallel to slot 26. The slots 26 and 28 are on opposite sides of the working portion 22 so that slot 28 can be slid to engage the snap tie 14 positioned to be pushed rather than pulled to push the snap tie 14 end 27 into aperture 16. Working end 22 has a nail holding cup 30 for holding the head of a nail 31. Cup 30 is cone-shaped or angled inward as shown in FIG. 5.

Figure 5:
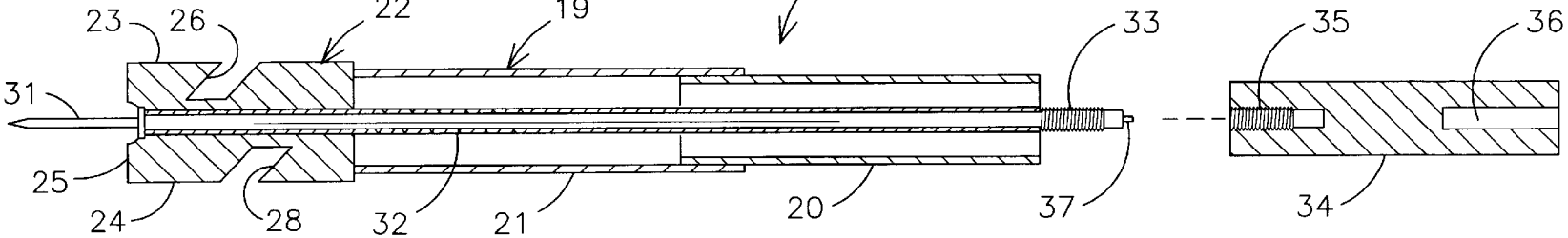
FIG. 5 is a sectional view of a concrete form snap tie tool of FIGS. 1–4.

As seen in FIG. 5, a stainless steel sleeve 32 runs through the body 19 of tool 10 and is threaded at one end with threads 33. The sleeve extends through the working head 22 of the tool. It is shaped to allow the handle 34 with an internal threaded bore 35 to be threaded onto the threads 33 of the sleeve 32. A hole 36 is on the opposite end of the head 34 but is not threaded and is used to break off snap ties when stripping a concrete form after concrete has been poured and cured. The hole 36 is slid over the snap tie end and twisted to break off the snap tie. Sleeve 32 end portion has a hitting surface 37 to allow it to be driven with a hammer 38 out of the sleeve through the body 19 to drive a nail 31 supported in the nail holding opening 30. The tool can also be used as a nail driving tool by using the attached handle 34 to grip and manually drive a nail by pushing the sleeve 32 with the handle. Body 19 is made, as illustrated in the figures, such that the body tube 21 is attached to the tool head 22 as a telescoping body portion 20 which can telescope thereinside.

It should be clear at this time that a concrete form snap tie tool has been provided for use in assembling a concrete form for spacing the walls of the concrete form snap ties for the rapid alignment of the snap ties with the apertures during the assembly of the form. It should be clear that the present tool can advantageously be utilized as a nail supporting tool supporting and driving a nail into a surface. However, the present concrete form snap tie tool should not be considered as limited to the forms shown, which are to be considered illustrative rather than restrictive.

I claim:

1. A concrete form snap tie tool for assembling a concrete form having two sides spaced by a plurality of snap ties comprising:

an elongated body having two end portions, one end portion having a handle thereon and the other end portion having first and second sides and an end edge, said first side having an angled slot therein for engaging a snap tie therein for pulling the snap tie and said second side having an angled slot therein for pushing a snap tie for aligning the snap tie with an aperture in a concrete form side wall, whereby a concrete form snap tie tool can rapidly engage a snap tie and align the snap tie with an opening in a concrete form during the assembly of the concrete form, and said elongated body having a slidable sleeve mounted therethrough having two ends, said sleeve being operatively connected at one end to an impact surface for driving said sleeve through said elongated body, and said elongated body having nail supporting means for supporting a nail on the end of said body in a position to be driven by said sleeve to drive said nail into a surface whereby a nail held in said nail supporting means can be driven by hitting said impact surface to drive said sleeve against said nail.

2. A concrete form snap tie-tool in accordance with claim 1 in which said elongated body first angled slot and said second angled slot are angled in the same direction from opposite sides of said other end portion of said elongated body whereby one side is for pulling and the other side is for pushing a concrete form snap tie.

3. A concrete form snap tie tool in accordance with claim 2 in which said sleeve is a stainless steel sleeve.

4. A concrete form snap tie tool in accordance with claim 1 in which said handle has a bore therein sized to fit over the end of a snap tie for breaking off said snap tie end when disassembling said concrete form.

* * * * *